US005727888A

United States Patent [19]

Sugimoto et al.

[11] Patent Number: 5,727,888

[45] Date of Patent: Mar. 17, 1998

[54] PRINTER AND A COMPOSITE CASSETTE INCLUDING A TAPE CASSETTE AND A RIBBON CASSETTE USED IN THE PRINTER

[75] Inventors: Kiyoshi Sugimoto, Kuwana; Koshiro Yamaguchi, Kasugai; Yutaka Sugiyama, Nagoya, all of Japan

[73] Assignee: Brother Kogyo Kabushiki Kaisha, Aichi-ken, Japan

[21] Appl. No.: 617,066

[22] Filed: Mar. 18, 1996

[30] Foreign Application Priority Data

Mar. 29, 1995 [JP] Japan ..... 7-100064
Nov. 1, 1995 [JP] Japan ..... 7-310037

[51] Int. Cl.[6] ..... B41J 11/48

[52] U.S. Cl. ..... 400/586; 400/247; 400/613; 400/615.2; 400/708

[58] Field of Search ..... 400/586, 615.2, 400/207, 207 E, 615.1, 246, 613, 703, 708, 208, 247

[56] References Cited

U.S. PATENT DOCUMENTS 5,188,469 2/1993 Nagao et al. .
5,193,919 3/1993 Godo et al. ..... 400/615.2
5,222,818 6/1993 Akiyama et al. ..... 400/615.2
5,374,132 12/1994 Kimura ..... 400/586
5,447,378 9/1995 Otsuka et al. ..... 400/615.1

FOREIGN PATENT DOCUMENTS 0 497 352 A 8/1992 European Pat. Off. .
0 526 078 A 2/1993 European Pat. Off. .
0 573 187 A 12/1993 European Pat. Off. .
0 592 198 A 4/1994 European Pat. Off. .
0 625 427 A 11/1994 European Pat. Off. .
59-222380 12/1984 Japan ..... 400/207 E
3-74956 7/1991 Japan .

*Primary Examiner*—John S. Hilten
*Attorney, Agent, or Firm*—Oliff & Berridge, PLC

[57] ABSTRACT

A label printer for printing tape-shaped labels. The label printer includes a freely detachably mountable tape cassette housing a tape; printing device including a print head for printing symbols and alphanumeric characters on the tape; controller for controlling printing operations; a freely detachably mountable ribbon cassette independent from the tape cassette, the ribbon cassette housing an ink ribbon; detector for detecting a type of the ribbon cassette; and an operation portion for operating the detector, the operation portion being provided to the ribbon cassette in a configuration corresponding to the type of ribbon cassette.

20 Claims, 11 Drawing Sheets

PRINTER AND A COMPOSITE CASSETTE INCLUDING A TAPE CASSETTE AND A RIBBON CASSETTE USED IN THE PRINTER

BACKGROUND OF THE INVENTION

1. Field of the Invention

The present invention relates to a composite cassette including a tape cassette and a ribbon cassette, to a printer in which the composite cassette can be used, and particularly to improving technology of a detection means for detecting type of tape housed in the tape cassette and type of ribbon housed in the ribbon cassette.

2. Description of the Related Art

U.S. Pat. No. 5,188,469 describes a tape-shaped label printer, which prints characters and marks, such as alphabetic characters and symbols, on a tape printing medium. The label printer is suitable for making labels to adhere to the backs of file folders. A variety of tape cassettes housing a print tape, which serves as a print medium, and an ink ribbon are available to print labels in various colors and with various widths. To change the print color or the width of the label to be produced, the tape cassette in the label printer is changed to one housing a tape with the desired width and an ink ribbon of a desired color.

Japanese Utility Model Application (KOKAI) No. HEI-3-74956 describes a composite cassette used in a label printer for preparing tape-shaped labels. The composite cassette includes an independent tape cassette and a ribbon cassette. The tape cassette houses a tape, which serves as a print medium, and is freely detachably mounted in the printer. The ribbon cassette, which houses an ink ribbon, is freely detachably mounted in the tape cassette.

SUMMARY OF THE INVENTION

It is desirable to print tapes in various colors without replacing the tape cassette, for example, by replacing only the ribbon cassette and printing; or by replacing only the ribbon cassette, rewinding the tape, and then printing. One step toward fulfilling this objective providing various types of ink ribbons in different widths and different colors, each type of ink ribbon being housed in a corresponding ribbon cassette.

However, multi-color printing with such a configuration would be impossible without a means for detecting the color of ink ribbon in the ribbon cassette. It is conceivable to provide a plurality of ink ribbon detection switches to the printer and to provide each ribbon cassette with a receptor portion corresponding to the type of ink ribbon housed in the ribbon cassette. However, this would require a great number of detection switches, which would make the detection system for detecting the type of ink ribbon expensive to manufacture. Also, to install all of the detector switches would require that the printer have a complicated configuration and large size.

It is an objective of the present invention to provide a printer that requires few detection switches and that has a simple structure and compact size.

To achieve the above-described objectives, a label printer according to the present invention for printing tape-shaped labels includes a freely detachably mountable tape cassette housing a tape; printing means including a print head for printing symbols and alphanumeric characters on the tape; control means for controlling printing operations; a freely detachably mountable ribbon cassette independent from the tape cassette, the ribbon cassette housing an ink ribbon; detection means for detecting a type of the ribbon cassette; and an operation portion for operating the detection means, the operation portion being provided to the ribbon cassette in a configuration corresponding to the type of ribbon cassette.

According to another aspect of the invention it is desirable that the detection means include a plurality of detection switches provided to the printer and a plurality of movable detection elements movably mounted to the tape cassette and for operating corresponding ones of the plurality of detection switches provided to the printer; and that the operation portion include at least one detected portion formed to the ribbon cassette in a preset combination pattern corresponding to type of ink ribbon in the ribbon cassette, the at least one detected portion moving at least one of the plurality of movable detection elements toward the plurality of detection switches.

A composite cassette according to the present invention is mountable in a printer including a print mechanism and a plurality of detection switches provided at a predetermined portion of the print mechanism. The composite cassette includes a freely detachably mountable tape cassette housing a tape; a freely detachably mountable ribbon cassette independent from the tape cassette, the ribbon cassette housing an ink ribbon; detection means for detecting a type of the ribbon cassette: and an operation portion for operating the detection switches of the printer, the operation portion being provided to the ribbon cassette at a portion thereof corresponding to the predetermined portion of the print mechanism and in a configuration corresponding to the type of ribbon cassette.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
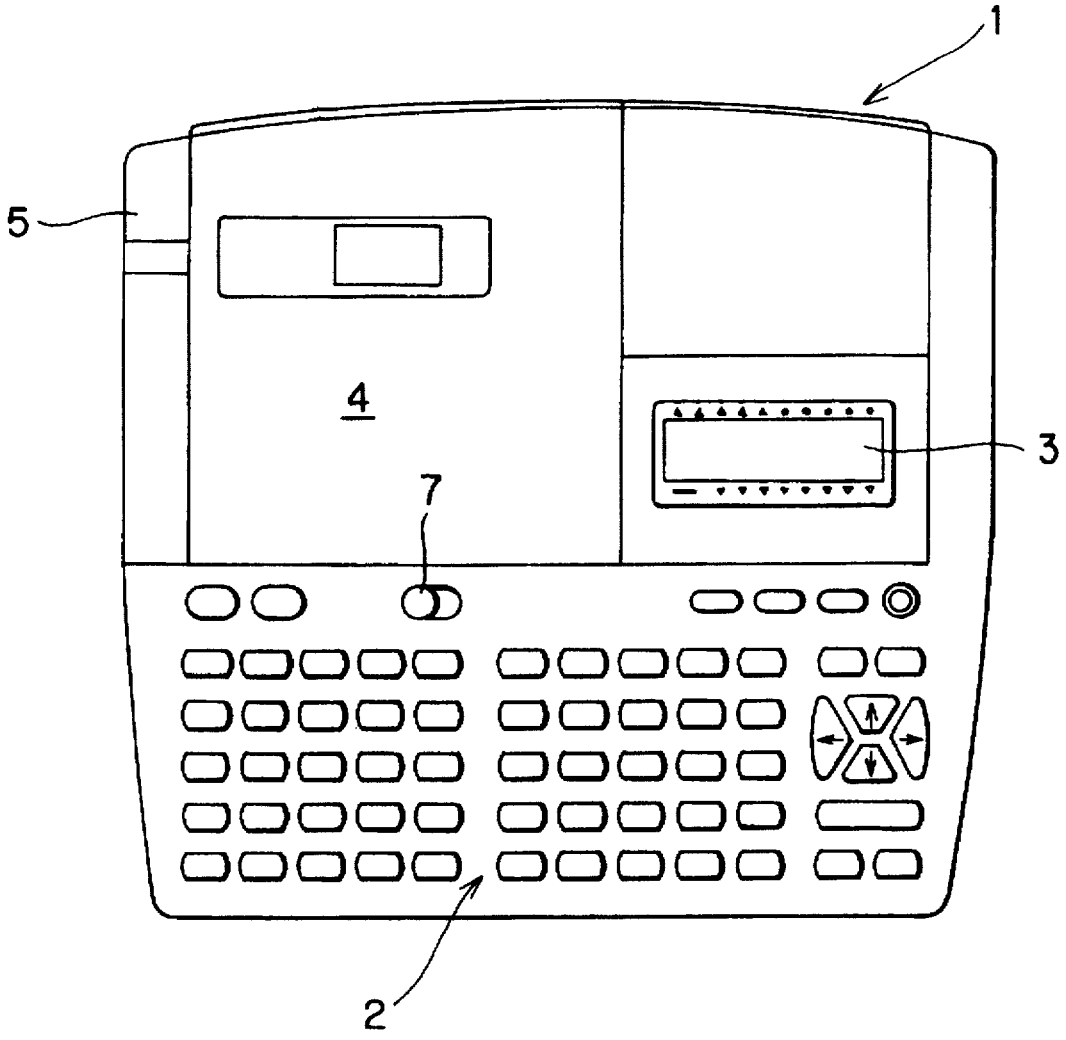
FIG. 1 is a plan view showing a label printer according to an embodiment of the present invention.
Figure 2:
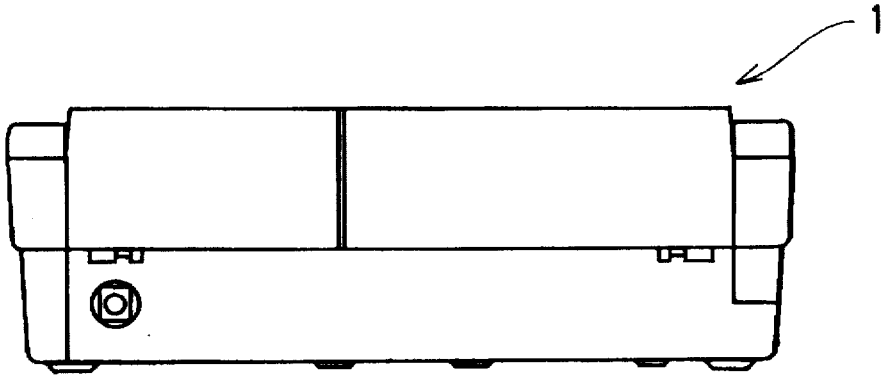
FIG. 2 is a rear view showing the printer of FIG. 1.
Figure 3:
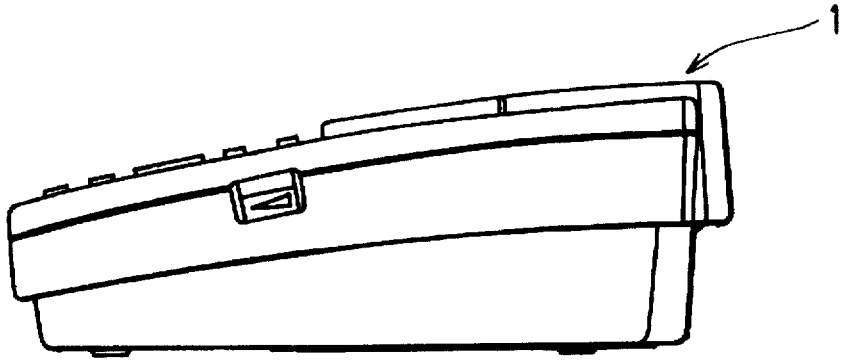
FIG. 3 is a right-side view showing the printer of FIG. 1.
Figure 4:
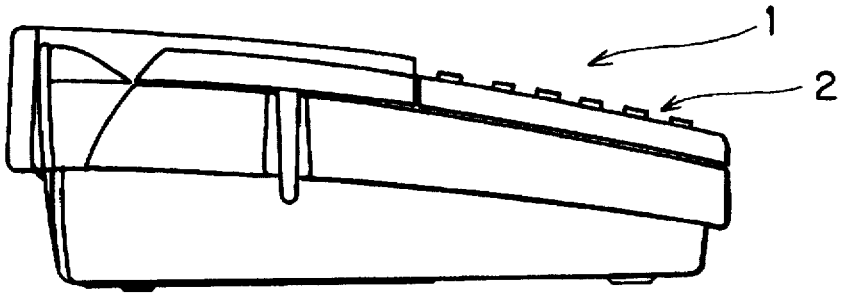
FIG. 4 is a left-side view showing the printer of FIG. 1.

A printer and a tape-ribbon composite cassette used in the printer according to a preferred embodiment of the present invention will be described while referring to the accompanying drawings wherein like parts and components are designated by the same reference numerals to avoid duplicating description. The present embodiment describes the present invention applied to a label printer and to a composite cassette used in the printer. In the embodiment the label printer is for producing tape-shaped labels by printing colored text, symbols, and characters on a tape, which serves as a print medium. The composite cassette includes a tape cassette freely detachably mounted in the printer and a ribbon cassette freely detachably mounted in the tape cassette. With this configuration, the ribbon cassette can be easily exchanged.

As shown in FIGS. 1 through 6, a printer 1 is provided at its upper surface with a keyboard 2, a display 3, a cassette cover 4, a cutter lever 5, and the like. Colored text, symbols, and characters to be printed are inputted using the keyboard 2. The inputted data and commands are stored in a memory such as a RAM (not shown). A print mechanism 6 is disposed beneath the cassette cover 4. The cassette cover 4 is designed to open up when a cover open lever 7 is slid to the right as viewed in FIG. 1. A tape cassette 50 can be mounted into the print mechanism 6 while the cassette cover 4 is in the opened condition shown in FIG. 6. A ribbon cassette 60 is constructed in independent form from the tape cassette 50. The tape cassette 50 is formed with a housing portion HP into which the ribbon cassette 60 can be freely detachably mounted while the tape cassette 50 is freely detachably mounted in the print mechanism 6. The tape cassette 50 and the ribbon cassette 60 freely detachably mounted to the tape cassette 50 comprise a composite cassette 560.

Figure 5:
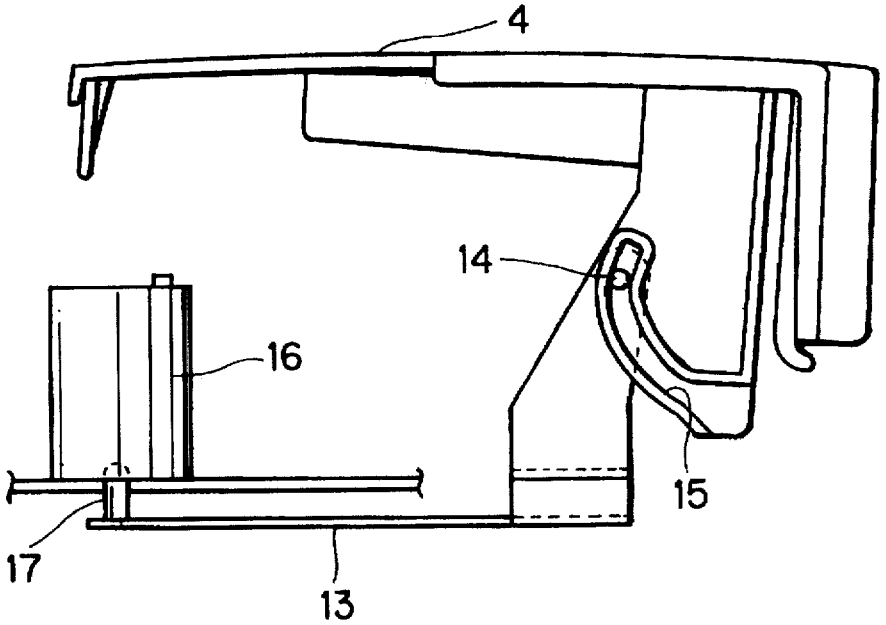
FIG. 5 is a cross-sectional side view showing a mechanism for connecting a cassette cover to a roller holder of the printer of FIG. 1, the cassette cover being in an open condition.
Figure 6:
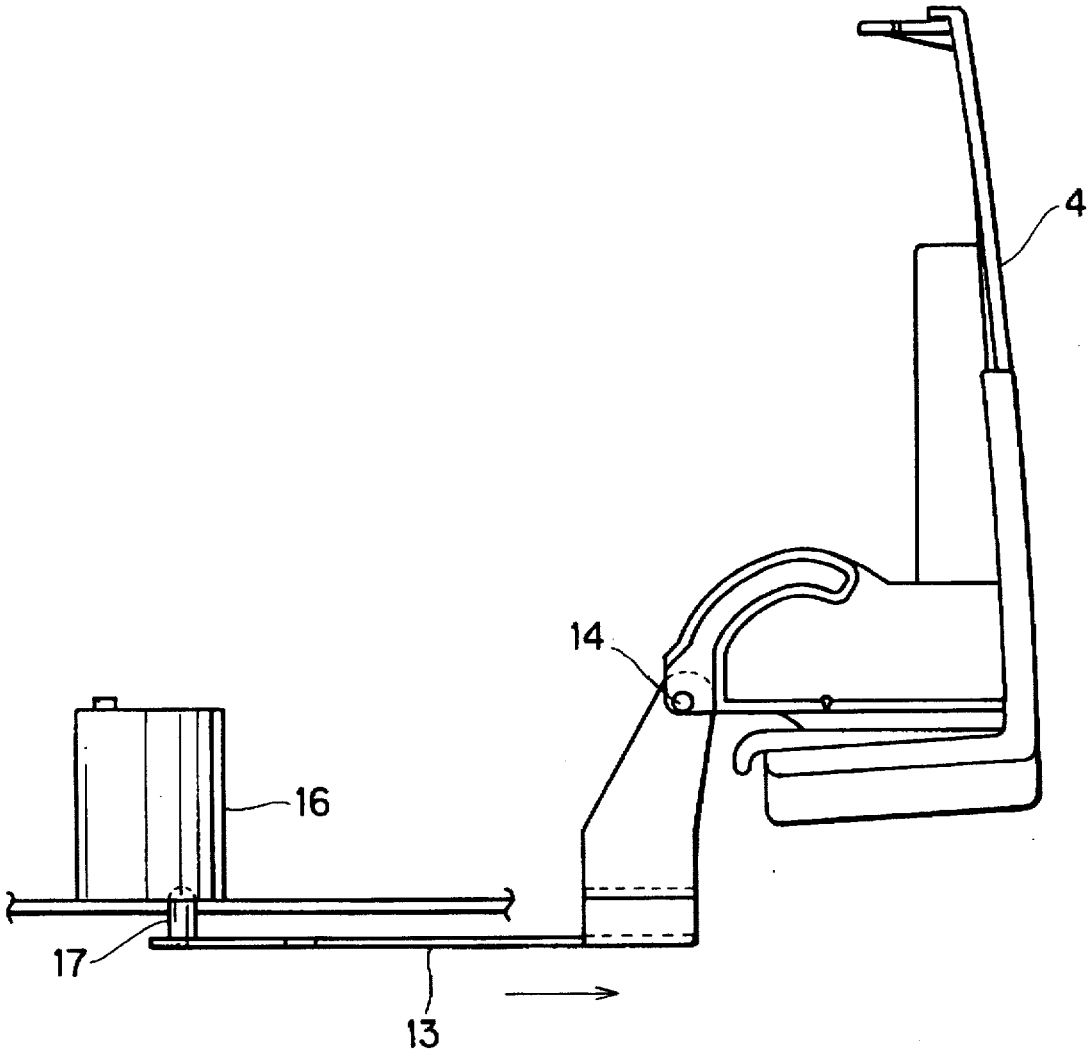
FIG. 6 is a cross-sectional side view showing the mechanism of FIG. 5, the cassette cover being in a closed condition.
Figure 7:
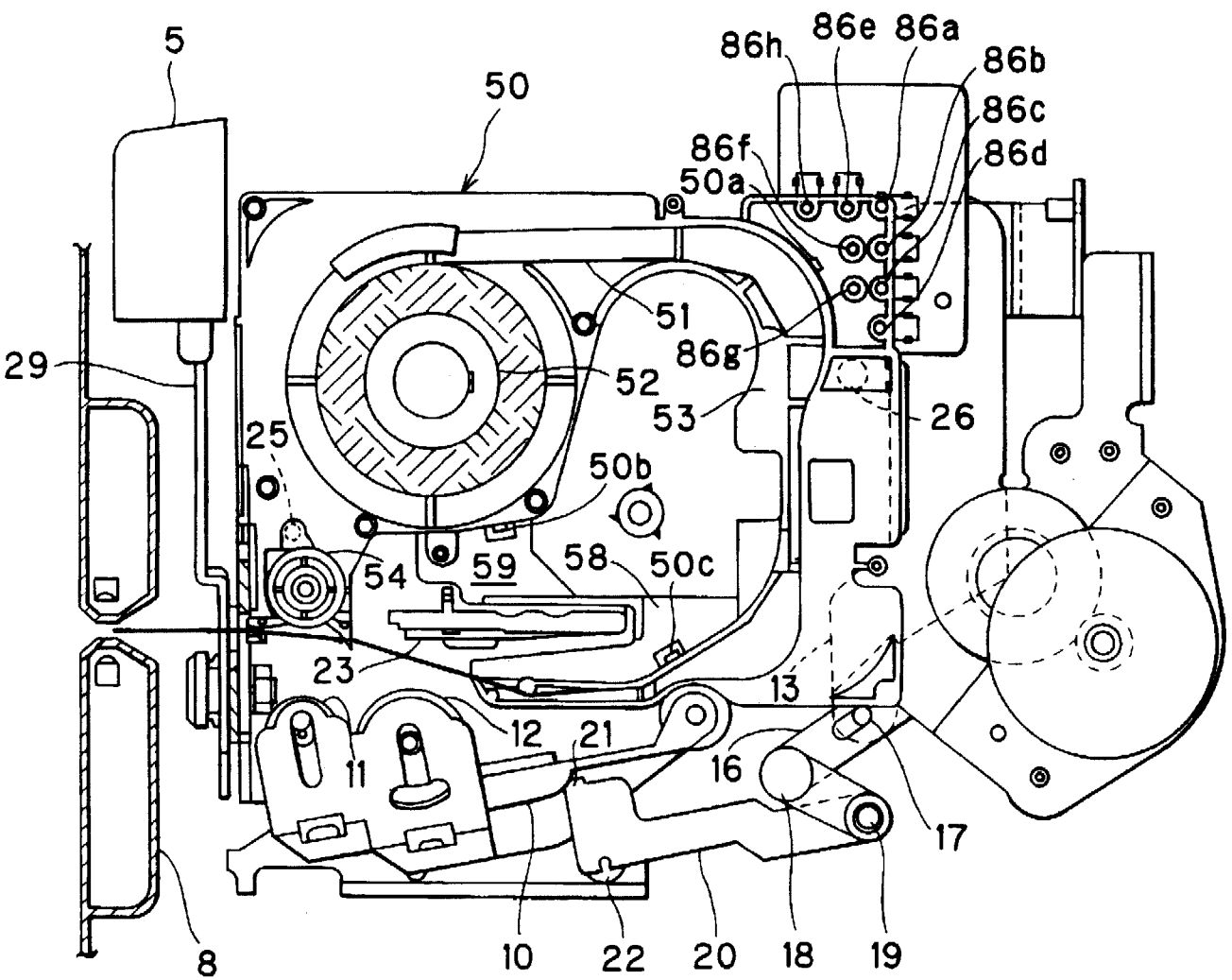
FIG. 7 is a plan view showing internal structure of a print mechanism of the printer and internal structure of a tape cassette mounted in the print mechanism.
Figure 8:
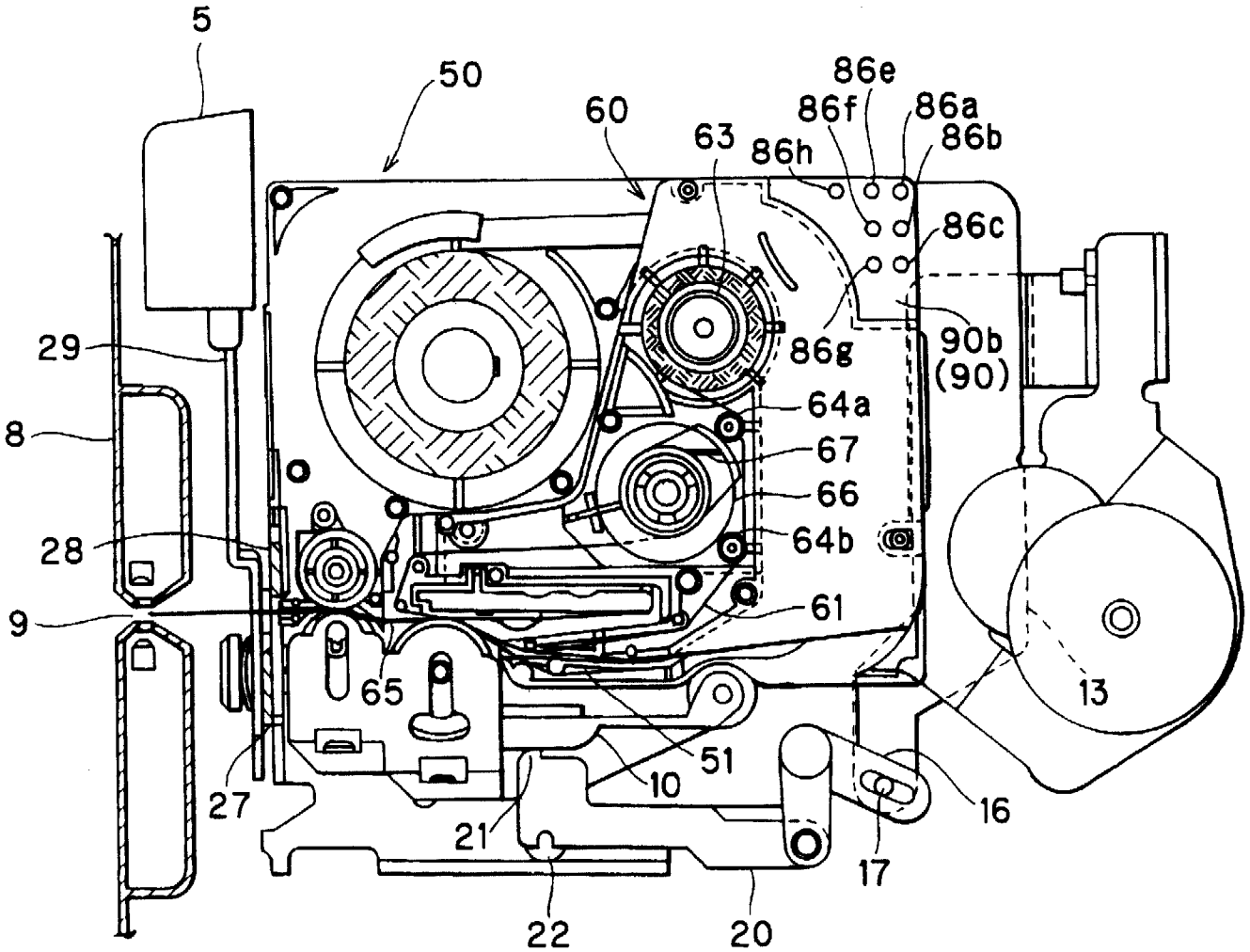
FIG. 8 is a plan view showing internal structure of the print mechanism, the tape cassette, and a ribbon cassette mounted in the tape cassette.
Figure 9:
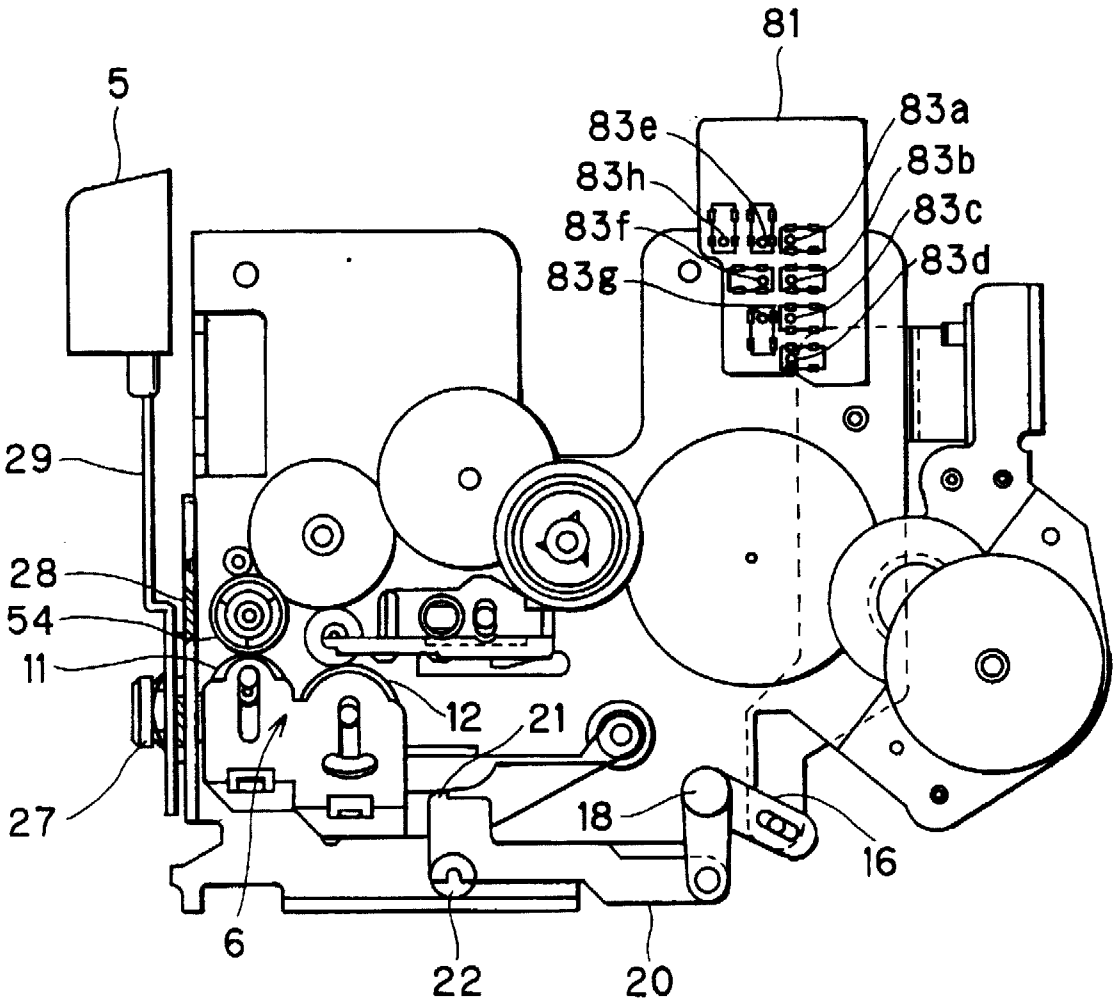
FIG. 9 is a plan view showing essential portions, such as detection switches, of the print mechanism while a print head of the print mechanism is in a pressing contact condition.
Figure 10:
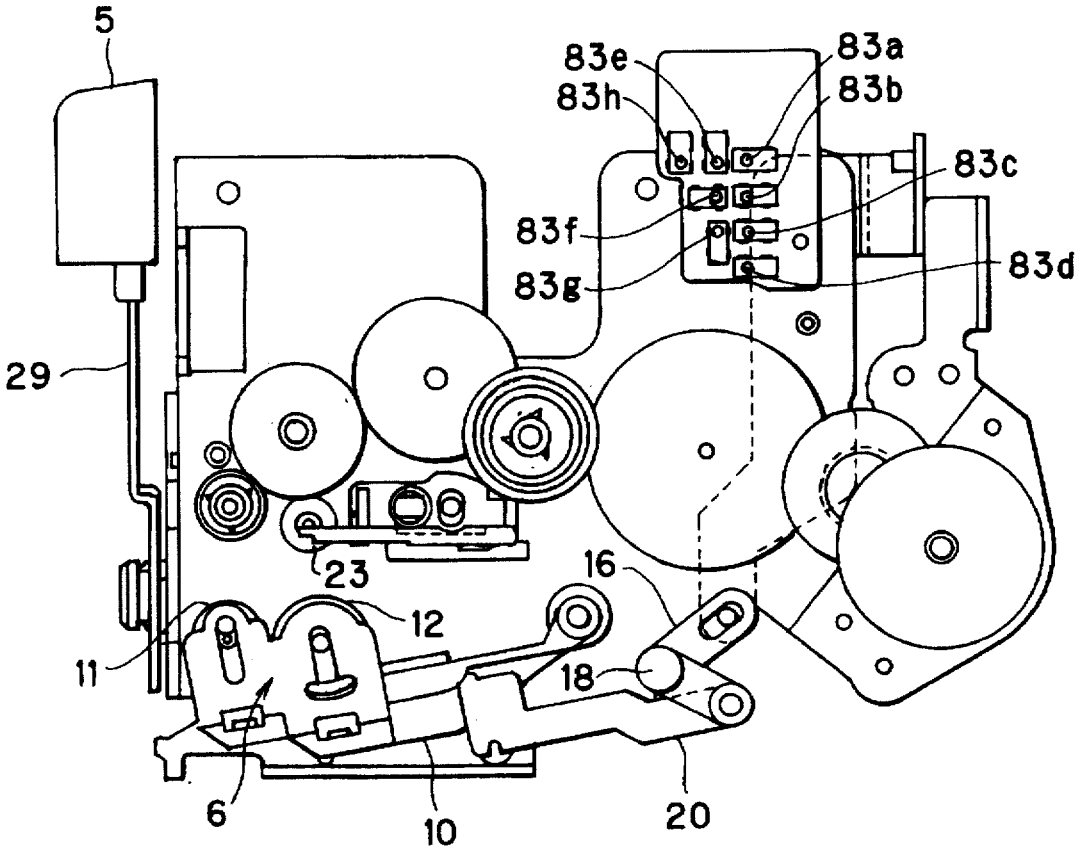
FIG. 10 is a plan view showing essential portions of the print mechanism while a print head is in a separated condition.

Next, an explanation of the print mechanism 6 will be provided while referring to FIGS. 5 through 10. FIG. 7 shows only the tape cassette 50 mounted in the print mechanism 6. FIG. 8 shows the composite cassette 560, which includes the tape cassette 50 and the ribbon cassette 60, mounted in the print mechanism 6 in a condition for normal printing. Positioning shafts 25, 26 are provided for positioning the tape cassette 50 vertically and horizontally in the print mechanism 6 and for positioning the ribbon cassette 60 in the tape cassette 50.

A sub roller 11 and a platen 12 are provided to a roller holder 10 so as to swing integrally with the roller holder 10. The roller holder 10 moves in association with opening and closing movement of the cassette cover 4. As shown in FIGS. 5 and 6, a shaft 14 of an operation plate 13 is movably engaged in a cam 15 of the cassette cover 4. When the cassette cover 4 is opened up, the operation plate 13 moves rightward as viewed in FIG. 6 and a release lever 16 engaged with a shaft 17 above the operation plate 13 rotates, centered on a support shaft 18, counterclockwise as viewed in FIGS. 7 and 8.

A shaft 19 connects the release lever 16 to a roller release rod 20. The roller release rod 20 is formed with a cam portion 21. The roller holder 10 moves between a pressing contact condition and a separated condition according to the shape of the cam portion 21. A roller 22 for abrasively sliding against the wall of the print mechanism 6 during leftward and rightward movement is attached to the roller release rod 20.

When the cassette cover 4 is opened up, the release lever 16 rotates counterclockwise as viewed in FIGS. 7 and 8, the roller release rod 20 moves rightward as viewed in FIGS. 7 and 8, and the roller holder 10 moves into the separated condition shown in FIG. 7 by a roller holder release spring (not shown in the drawings). On the other hand, when the cassette cover 4 is closed shut, the operation plate 13 moves leftward as viewed in FIG. 5, the release lever 16 rotates clockwise as viewed in FIGS. 6 and 7, the roller release rod 20 moves leftward, and the roller holder 10 moves via the cam portion 21 into the pressing contact condition shown in FIG. 8. A sub roller 11 and a platen 12 are provided to the roller holder 10. When the cassette cover 4 is closed shut, the roller holder 10 swings in association therewith into the pressing contact condition so that the sub roller 11 and the platen 12 are brought into pressing contact with the thermal head 23.

As shown in FIGS. 7, 8, and 11 through 14, a tape 51, serving as a print medium, is wound around a tape spool 52 and mounted in the tape cassette 50. A tape guide 53 guides the tape 51 along the front surface of a thermal head 23. Then, a tape feed roller 54 of the tape cassette 50 and sub roller 11 of the print mechanism 6 guide the tape 51 out of the tape cassette 50.

Figure 12:
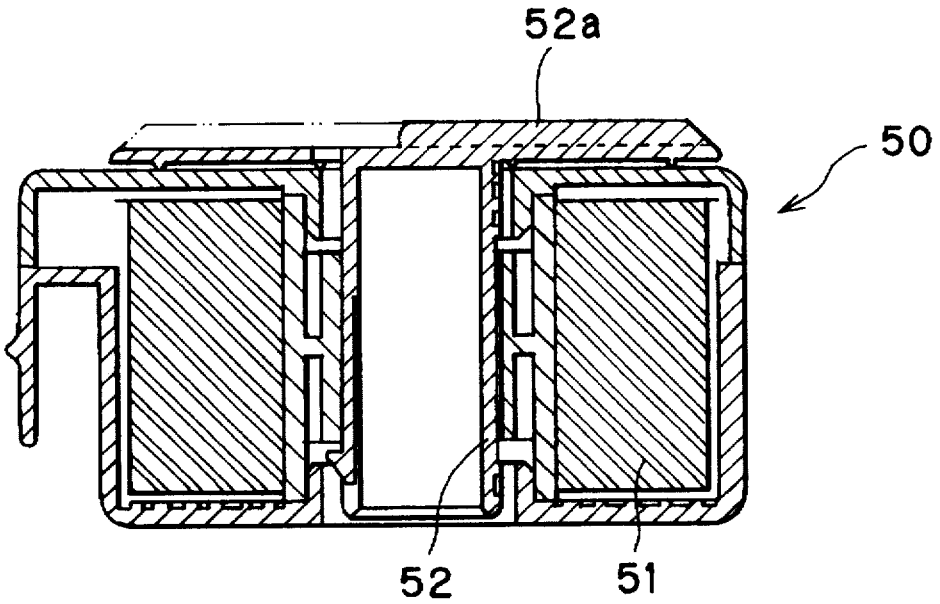
FIG. 12 is a vertical cross-sectional view showing the tape cassette.

As shown in FIG. 12, a tape grip 52*a* is engaged with the tape spool 52 so as to rotate integrally with the tape spool 52. The tape 51 can therefore be rewound by manually rotating the tape grip 52*a*. The ribbon cassette 60 is formed with a upper wall portion 62 which partially overlaps the upper surface of the tape cassette 50 when the ribbon cassette 60 is mounted in the tape cassette 50. FIG. 7 shows the ribbon cassette 60 removed from the tape cassette 50 and the cassette cover 4 in an open condition so that the roller holder 10 is in the separated condition. In this condition, the tape 51 can be rewound by rotating the tape grip 52*a*.

A rectangular opening 55 is formed at one position in the outer wall storing the tape spool 52 of the cutter lever 5. The opening 55 is formed to the outer wall of the case near the pathway through which the tape 51 is guided. When the tape 51 is rewound too much so that the tip edge of the tape 51 draws back into the case of the tape cassette 50, an operator can feed the tape 51 by using his or her finger to push, in the feed direction, the portion of the tape 51 exposed at the opening 55. The opening 55 has a narrower width than the tape 51 so that the tape 51 will not be guided out of the tape cassette 50 through the opening 55. Also, the surface of the tape 51 exposed at the opening 55 is the opposite surface on which printing is performed. Therefore, the print surface of the tape 51 will not be stained or dirtied by an operator's fingers.

Figure 13:
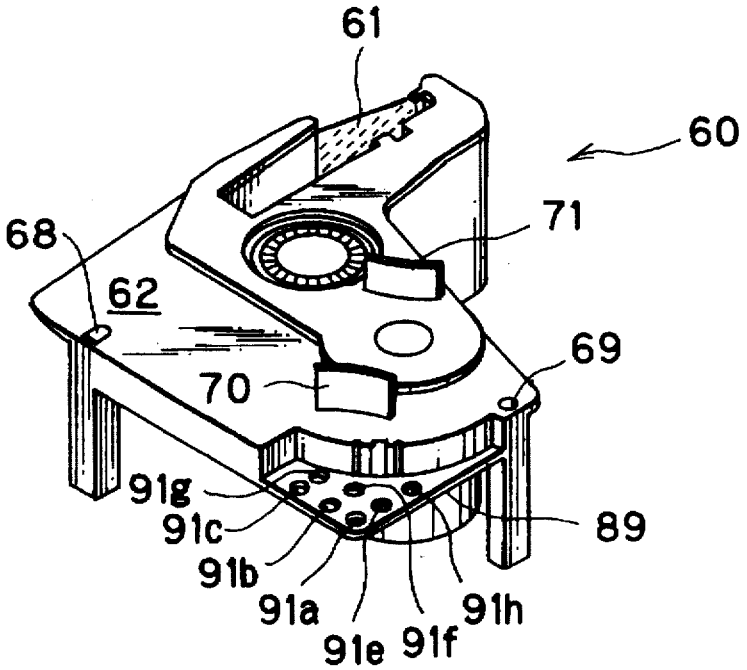
FIG. 13 is a perspective view showing the ribbon cassette.
Figure 14:
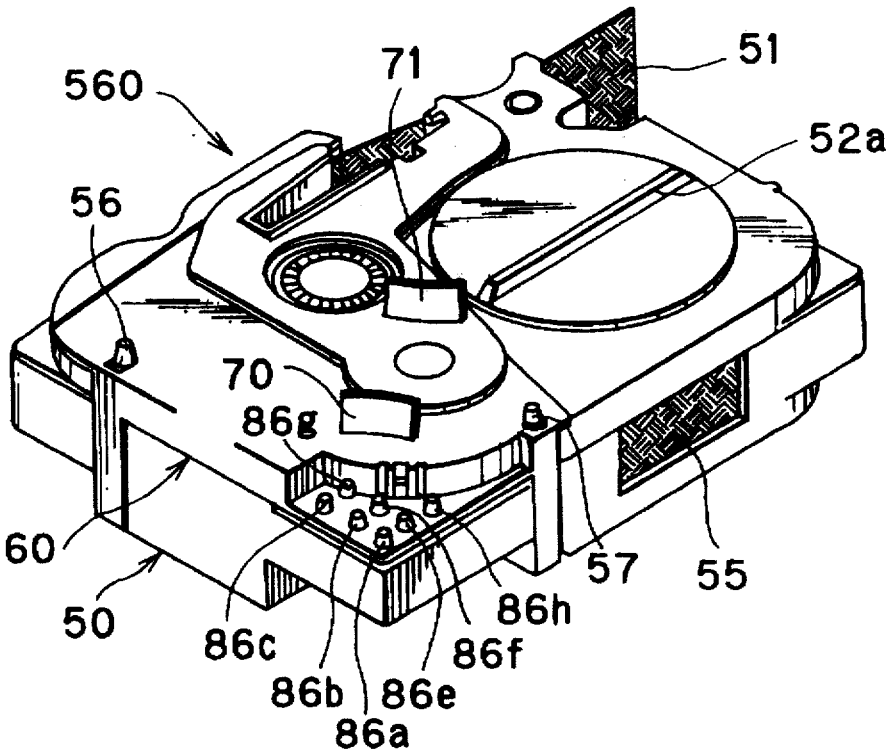
FIG. 14 is a perspective view showing a composite cassette including the tape cassette and the ribbon cassette.

As shown in FIGS. 8 and 13, an ink ribbon 61 wound around a ribbon spool 63 is mounted in the ribbon cassette 60. The ink ribbon 61 is guided along the front surface of the thermal head 23 by ribbon guides 64*a*, 64*b* and wound up on a retrieval spool 66 via a guide rod 65. A clutch spring 67 for preventing the ink ribbon 61 from loosening is attached to the lower part of the retrieval spool 66.

As shown in FIG. 7, pawls 50*a*, 50*b*, and 50*c* are provided to the tape cassette 50 for positioning and fixing at three positions the ribbon cassette 60 vertically and horizontally with regards to the tape cassette 50. Two shafts 56, 57 for positioning the tape cassette 50 are provided to the tape cassette 50. The shafts 56, 57 are engaged in holes 68, 69 respectively of the ribbon cassette 60.

Figure 11:
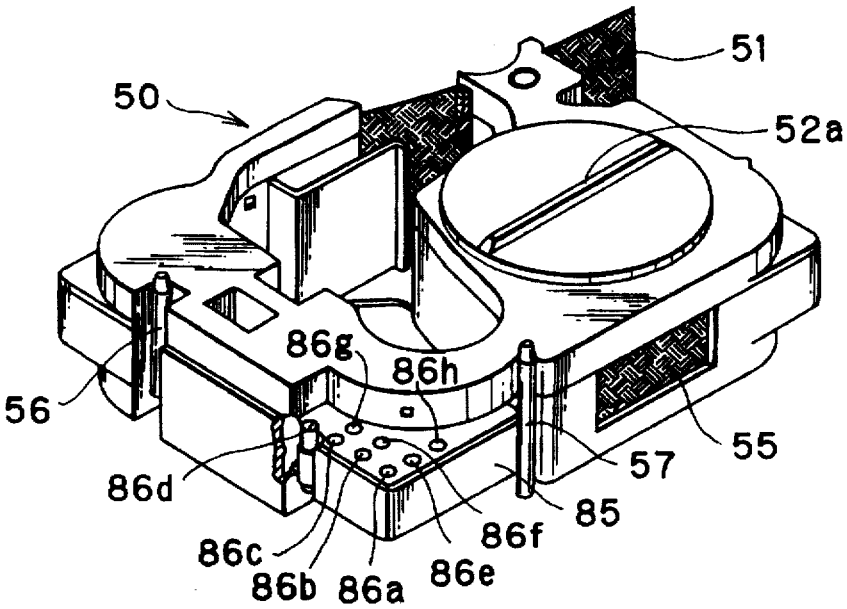
FIG. 11 is a perspective view showing the tape cassette.

AS shown in FIG. 11, the shafts 56, 57 protrude above the upper surface of the tape cassette 50. When mounting the ribbon cassette 60, first the shafts 56, 57 are engaged in holes 68, 69 respectively. This positions the ribbon cassette 60 two dimensionally in the horizontal direction. Because of this, the ribbon cassette 60 is mounted with almost no contact between the outer sidewall of the ribbon cassette 60 and the inner side wall of the tape cassette 50 even if the ribbon cassette 60 is pressed further into the tape cassette 50. Accordingly, mounting the ribbon cassette 60 to the tape cassette 50 can be performed much more smoothly than if performed using the inner sidewall of the tape cassette 50 and the outer sidewall of the ribbon cassette 60. The ribbon cassette 60 can be smoothly attached and detached when the ribbon cassette 60 is replaced while the tape cassette 50 is mounted in the print mechanism 6.

As shown in FIG. 13, a pair of grips 70, 71 are formed to the upper wall of the ribbon cassette 60. By gripping the grips 70, 71, the ribbon cassette 60 can be easily attached and detached from the tape cassette 50. Positioning of the ribbon cassette 60 in the vertical direction with regards to the tape cassette 50 is performed by abutting the base surface of the ribbon cassette 60 against the surfaces 58, 59 of the tape cassette 50.

The ribbon cassette 60 is fixed in the tape cassette 50 by engaging the pawls 50*a*, 50*b*, and 50*c* of the tape cassette 50 in three holes (not shown in the drawings) of the ribbon cassette 60. The three holes of the ribbon cassette 60 and the pawls 50*a*, 50*b*, and 50*c* of the tape cassette 50 are disposed at positions that differ depending on the type of tape cassette 50 and ribbon cassette 60. For example, the holes and pawls are configured so that only a cassette 60 for a 24 mm width receptor tape ribbon can be mounted in a tape cassette 50 for a 24 mm width receptor tape.

The portion of the ink ribbon 61 guided along the front surface of the thermal head 23 contacts the front surface of the thermal head 23. At this point, the tape 51 overlaps the front surface of the ink ribbon 61. Dot patterns are printed on the tape 51 by the thermal head 23 while the platen 12 presses the tape 51 and the ink ribbon 61 against the thermal head 23.

The tip edge of the printed tape 51 passes between a movable blade 27 and a receptor blade 28, which collectively comprise a cutter mechanism, and is guided out of the slit 9 formed in the main body case 8. A connection plate 29 connects the movable blade 27 to the cutter lever 5. The tape 51 is cut by the movable blade 27 and the receptor blade 28 upon operation of the cutter lever 5.

Next, an explanation of a tape ribbon detection mechanism 80 for detecting the type, that is, width, configuration, and the like, of the tape 51 of the tape cassette 50 mounted in the printer 1 and the type, that is, width, ink color, and ink type, of the ink ribbon 61 of the ribbon cassette 60 mounted in the tape cassette 50 will be provided while referring to FIGS. 7 through 18 and Table 1.

Figure 15:
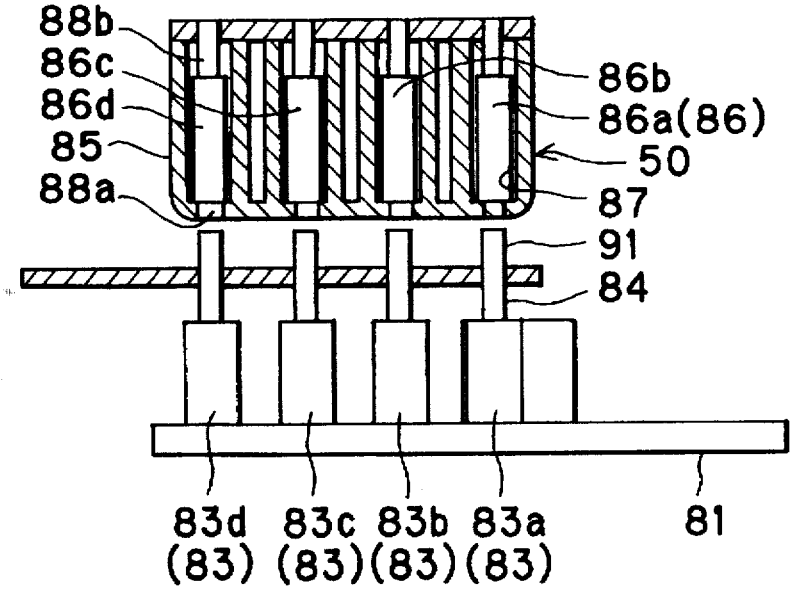
FIG. 15 is a vertical cross-sectional view showing a portion of a tape ribbon detection mechanism including the detection switches and a movable detection element portion of the tape cassette.

A switch attachment portion 81 is provided to the print mechanism 6 at a portion of the inner floor of the printer 1 that corresponds to the rear-right of the tape cassette 50 as viewed in FIG. 7. As shown in FIG. 15, eight detection switches 83, that is, 83*a* through 83*h*, are provided with an upright posture in the switch attachment portion. Each of the switches 83 has a detector 84 urged upward by a spring housed in the respective detector switch 83.

As shown in FIG. 15, a movable detection element portion 85 is provided to a peripheral side of the tape cassette 50 at a position corresponding to the switch attachment portion 81. The movable detection element portion 85 is formed with eight open mounting holes 87 in which eight movable detection elements 86, that is, 86*a* through 86*h* that correspond to each of the eight detection switches 83*a* through 83*h*, are mounted with an upright posture and freely vertically slidable at a predetermined stroke. Each movable detection element 86 is formed from a resin rod with a short, small-diameter portion 88*a* formed to its lower tip and a long, small-diameter portion 88*b* formed to its upper tip.

Figure 16:
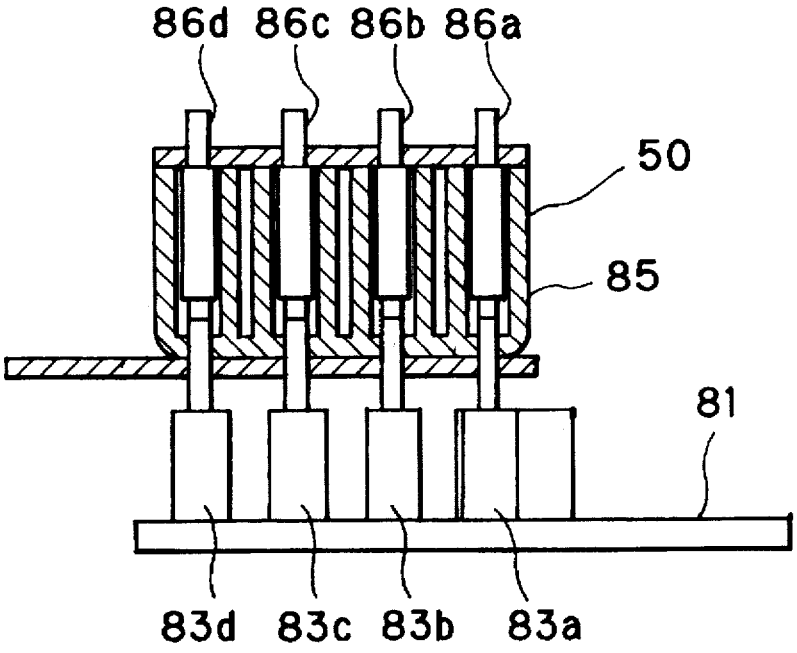
FIG. 16 is a vertical cross-sectional view showing the movable detection element portion mounted on the detection switches.

When the tape cassette 50 is incompletely mounted to the printer 1, as shown in FIG. 15, the movable detection elements 86 are contained fully within the mounting holes 87. When the tape cassette 50 is completely mounted, as shown in FIG. 16, the detectors 84 of the detection switches 83 urge the movable detection elements 86 upward to protrude from the mounting holes 87 by a predetermined distance.

A detection wall 89 is provided to the ribbon cassette 60 at the lower edge of a wall that depends perpendicularly from the upper wall portion 62. The detection wall 89 is located at a position corresponding to the movable detection element portion 85 of the tape cassette 50 and so will be positioned at the outer periphery of the tape cassette 50 when the ribbon cassette 60 is mounted in the tape cassette 50. One or a plurality of detected portions 90, that is, 90*d* in this example, and escape holes 91, that is, 91*a* through 91*c* and 91*e* through 91*h* in this example, are formed to the detection wall 89 in a preset combination pattern that varies depending on the type of tape 51 in the tape cassette 50 and the type of ink ribbon 61 in the ribbon cassette 60. When the ribbon cassette 60 is properly mounted in the tape cassette 50, the detected portion or portions 90 press corresponding ones of the eight movable detection elements 86*a* through 86*h* back into the mounting holes 87 against urging force of the springs in the detection switches. On the other hand, the escape holes 91 allow corresponding ones of the movable detection elements 86 to protrude therethrough.

TABLE 1

| DETECTION SWITCH NUMBER | | | | | | | | Detection |
|---|---|---|---|---|---|---|---|---|
| 83a | 83b | 83c | 83d | 83e | 83f | 83g | 83h | Results |
| ON | | | | | | | | REC;18; BLACK |
| | ON | | | | | | | REC;18;RED |
| | | ON | | | | | | REC;18;BLUE |
| | | | ON | | | | | REC;24; BLACK |
| | | | | ON | | | | REC;24;RED |
| | | | | | ON | | | REC;24;BLUE |
| | | | | | | ON | | LET;18; BLACK |

TABLE 1-continued

| DETECTION SWITCH NUMBER | | | | | | | | Detection |
|---|---|---|---|---|---|---|---|---|
| 83a | 83b | 83c | 83d | 83e | 83f | 83g | 83h | Results |
| | | | | | | | ON | LET;18;RED |
| ON | ON | | | | | | | LET;18;BLUE |
| | ON | ON | | | | | | LET;24; BLACK |
| | | ON | ON | | | | | LET;24;RED |
| | | | ON | ON | | | | LET;24;BLUE |

Table 1 shows a tape ribbon determination table indicating the relationship between ON/OFF condition of each of the detection switches 83*a* through 83*h* and corresponding types of tape 51 and types of ink ribbon 61 in the tape cassette 50 and the ribbon cassette 60. Data of the tape ribbon determination table is preinput and stored as pattern combinations in a ROM of a control device (not shown in the drawings), such as a microcomputer, of the printer 1. The control device detects the type of tape 51 and type of ink ribbon 61 by matching the detection signal from the detection switches 83*a* through 83*h* with the tape ribbon determination table. Based on this information, the control device controls the print mechanism 6, the display 3, and the like.

In the present embodiment, the tape 51 of the tape cassette 50 is a 34 mm wide receptor tape and the ink ribbon 61 in the ribbon cassette 60 is a black ink ribbon so that one detected portion 90*d* is formed in correspondence with the detection switch 83*d* to turn the detection switch 83*d* on. It should be noted that in Table 1, REC represents receptor tapes, LET represent lettering tapes, 18 represents 18 mm wide ink ribbons, 24 represents 24 mm wide ink ribbons, and BLACK, RED, and BLUE represent ink ribbons in these colors. Receptor tapes are print tapes without lamination and lettering tapes are tapes capable of transferring printed character trains and the like onto the surface of a separate sheet. The combination patterns shown in Table 1 are only examples. Many other combination patterns are possible.

Next, the operation of a tape ribbon detection mechanism 80 will be explained. As shown in FIG. 15, when the tape cassette 50 is incompletely mounted in the print mechanism 6, the movable detection elements 86*a* through 86*h* are contained within the mounting holes 87 and none of the detection switches 83*a* through 83*h* is operated. Because none of the switches is operated, it is determined that the mounting condition of the tape cassette 50 and the ribbon cassette 60 is incomplete. Therefore, printing is not allowed.

When as shown in FIG. 16 the tape cassette 50 is completely mounted, but no ribbon cassette 60 is mounted, again none of the detection switches 83*a* through 83*h* is operated. That is, while only the tape cassette 50 is mounted in the printer 1, no detected portion 90 of the ribbon cassette 60 will be present. Therefore, none of the movable detection elements 86*a* through 86*h* will be urged toward the detection switches 83*a* through 83*h* so that all of the detection switches 83*a* through 83*h* of the printer 1 will remain turned off. Therefore, as described above the mounting condition, or installation, of the tape cassette 50 and the ribbon cassette 60 is determined to be incomplete so that printing operations are not allowed.

Figure 17:
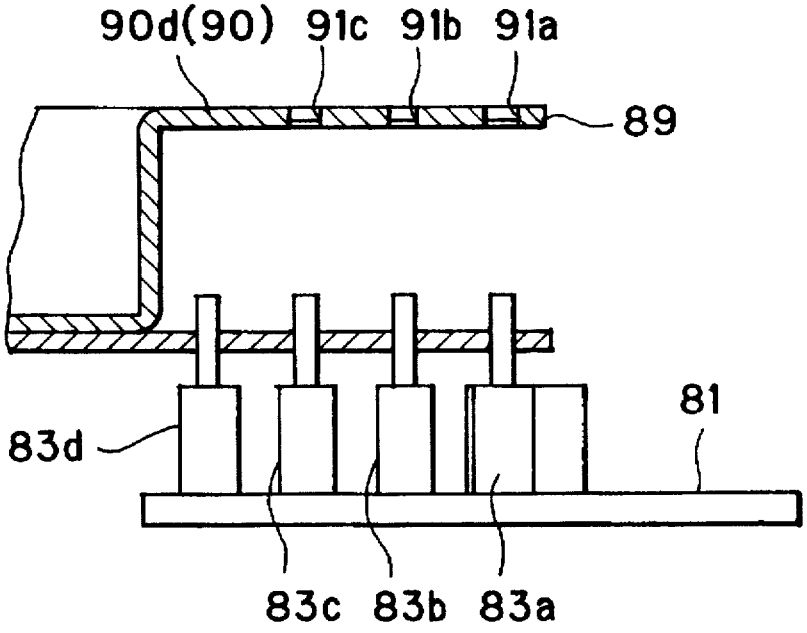
FIG. 17 is a vertical cross-sectional view showing another portion of the tape ribbon detection mechanism including the detection switches and a detection wall.

When as shown in FIG. 17 only the ribbon cassette 60 is mounted without the tape cassette 50, none of the detection switches 83*a* through 83*h* will be operated because no movable detection elements 86*a* through 86*h* are present. That is, no moveable detection elements 86*a* through 86*h* are present to transfer the pressing force of the detected portions 90 to overcome urging force of the springs in corresponding detection switches 83*a* through 83*h*. Therefore, it is determined that the mounting condition of the tape cassette 50 and the ribbon cassette 60 is incomplete so that print operations are not allowed. Because printing can not be performed without the tape 51, ink from the ink ribbon 61 can be prevented from staining the platen 12.

Figure 18:
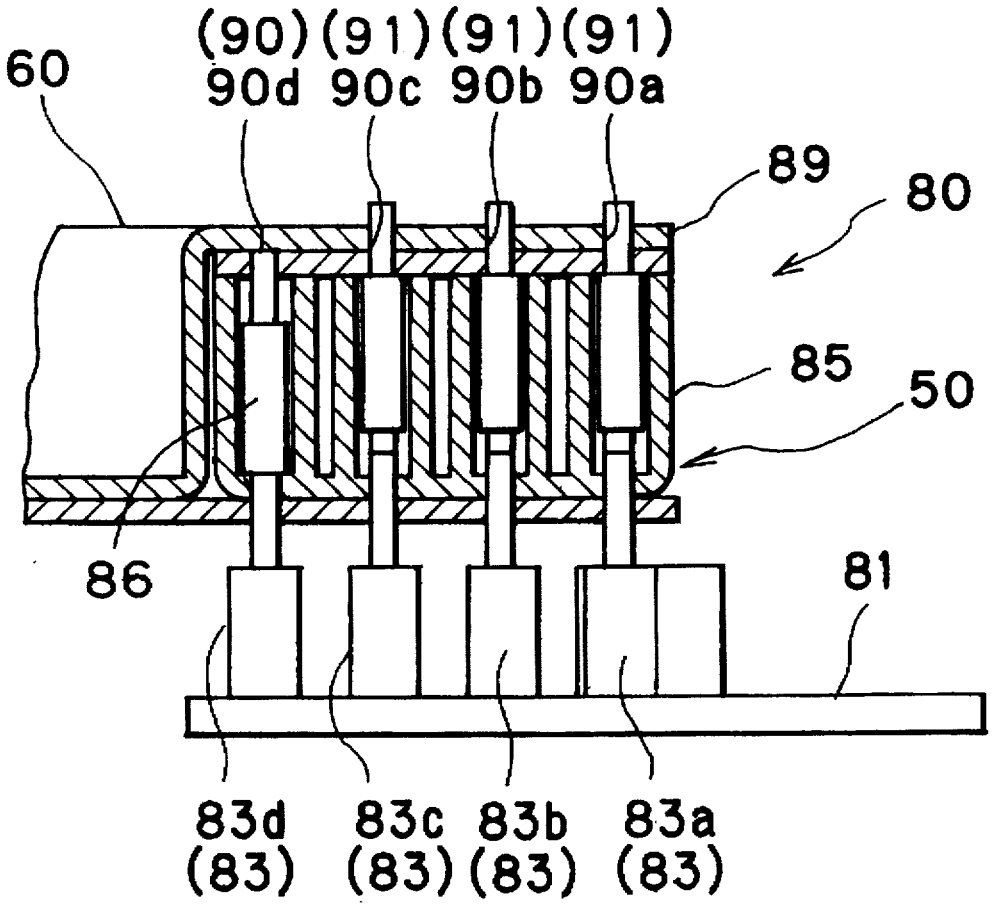
FIG. 18 is a vertical cross-sectional view showing essential portions of the complete tape ribbon detection mechanism.

When as shown in FIG. 18 the tape cassette 50 is completely mounted in the print mechanism 6 and the ribbon cassette 60 is completely mounted in the tape cassette 50, then the detected portions 90 formed to the detection wall 89 of the ribbon cassette 60 will press downward on corresponding ones of the movable detection elements 86. Because the movable detection elements 86 are mounted in open-ended mounting holes so as to be movable in a predetermined stroke therein, those movable detection elements 86 corresponding to detected portions 90 will move toward corresponding detection switches 83 of the printer 1, thereby turning the corresponding detection switches on.

Because the detected portions 90 are configured in a combination pattern preset according to the type of ink ribbon 61 in the ribbon cassette 61 and so as to move at least one of the plurality of movable detection elements 86 toward the detection switches 83 accordingly, the type of tape 51 in the tape cassette 50 and the type of ink ribbon 61 in the ribbon cassette 60 can be determined by the detection signal from the plurality of detection switches 83. Because the type of ribbon can be detected, a predetermined portion of the text or symbols or characters to be printed can be printed in a set color when performing multi-colored printing by printing in a plurality of colors in the same printing region of the tape.

Also, because escape holes 91 are formed in the ribbon cassette 60, movable detection elements 86 which are not moved toward the detection switches 83 by detected portions 90 will protrude through the escape holes 91 so that corresponding detection switches 83 will remain turned off. It will then be determined that both the tape cassette 50 and the ribbon cassette 60 are properly mounted.

Also, because the tape cassette 50 is formed with the housing portion HP, the ribbon cassette 60 can be mounted in the tape cassette 50. Separate space for the ribbon cassette 60 need not be provided in the print mechanism 6 so that the printer 1 can be formed in a more compact size.

Additionally, because ribbon cassettes 60 and tape cassettes 50 are configured so that only a corresponding type of ribbon cassette 60 can fit in the housing portion HP of a corresponding tape cassette 50, both the type of tape 51 and type of the ink ribbon 61 can be determined by referring to the tape ribbon determination table. That is, when the ribbon cassette 60 holds a 24 mm black ink ribbon 61 for a receptor-type tape as in the present embodiment, then the ribbon cassette 60 has a configuration that allows mounting it only in a 24 mm wide receptor-type tape cassette 50. Therefore, when it is determined that both the tape cassette 50 and the ribbon cassette 60 are properly mounted, then both the type of ribbon 61 and the type of the tape 51 can be determined based on a detection signal from detection switches turned on according to the pattern of the detection wall 89 of the ribbon cassette 60.

The following various effects can be obtained by, providing a plurality of detection switches 83 to the printer 1, providing to the tape cassette 50 a plurality of movable detection elements 86 corresponding to the plurality of detection switches 83, providing to the ribbon cassette 60 one or a plurality of detected portions 90 corresponding to a portion or all of the plurality of detection switches 83, and by configuring these components so that the one or plurality of the detected portions 90 operates, via the movable detection elements 86, one or a plurality of the detection switches 83.

Because the type of tape 51 and the type of ink ribbon 61 are detected by common detection switches 83, the required number of detection switches 83 and production costs can be reduced to less than when the type of tape 51 and the type of ink ribbon 61 are detected using independent detection switches. Because less space is needed to install the detection switches 83, the configuration of the printer 1, the tape cassette 50, and the ribbon cassette 60 can be simplified and downsized. Because the movable detection element portion 85 is provided at the lower edge at an outer side of the tape cassette 50, the movable detection element portion 85 can be provided to an external side of the tape cassette 50. Therefore, gears and the like provided for the tape transport mechanism and under the tape cassette 50 are not interfered with. This simplifies design of the tape cassette 50.

All of the detection switches 83 will be in an off condition when only one of the tape cassette 50 or the ribbon cassette 60 is mounted. Therefore, printing operations can be prevented in either of these conditions. As a result, printing when only the ribbon cassette 60 is mounted can be reliably prevented so that the platen 12 will not be stained.

While the invention has been described in detail with reference to specific embodiments thereof, it would be apparent to those skilled in the art that various changes and modifications may be made therein without departing from the spirit of the invention, the scope of which is defined by the attached claims.

For example, although eight each detection switches 83 and movable detection elements 86 are provided to the tape ribbon detection mechanism 80 of the above-described embodiment, more or less than eight can be provided. Detection switches 83 and movable detection elements 86 can be provided in numbers appropriate for their intended usage.

Many combination patterns can be provided to the tape ribbon determination table other than those shown in Table 1. For example, only one of the color and width of ink ribbons need be detected. Situations may arise where detecting only one or neither of these characteristics is beneficial. For example, detection of the ink ribbon color is convenient when ribbon cassettes housing various colored ink ribbons are available, but detecting width may not necessary if all the ink ribbons are of the same width. In this case, the operation portions would be configured to reflect only color of the housed ink ribbon and a ribbon color detecting means would be provided to the detection mechanism.

Contrarily, detection of the ink ribbon width is convenient when ribbon cassettes housing various width ink ribbons are available, but detecting color may not be necessary if all the ink ribbons have the same color. In this case, the operation portions would be configured to reflect only width of the housed ink ribbon and a ribbon width detecting means would be provided to the detection mechanism.

Additionally, characteristics other than color and width of the ink ribbon can be detected. Also, although the tape ribbon determination table of the above-described embodiment lists conditions where only one or two detection switches are on at the same time, patterns wherein three or more detection switches 83 are on at the same time can be provided.

A spring member for urging the movable detection elements 86 can be provided in the mounting holes 87. Also, the form or configuration of the movable detection elements 86 or the form or configuration of the mounting holes 87 can be modified in various ways. Proximity switches can be used instead of the detection switches 83.

The tape ribbon detection mechanism 80 can be used for a composite cassette wherein the ribbon cassette is not mounted in the tape cassette. Also, the tape ribbon detection mechanism 80 can be used for a composite cassette including a first tape cassette and a second tape cassette wherein the first tape cassette houses a first tape and is freely detachably mounted in the printer and wherein the second tape cassette houses a second tape and is freely detachably mounted in the second tape cassette.

What is claimed is:

1. A label printer for printing tape-shaped labels, the label printer comprising:

a freely detachably mountable tape cassette housing a tape;

a printing device including a print head for printing symbols and alphanumeric characters on the tape;

a controller controlling printing operations;

a freely detachably mountable ribbon cassette independent from the tape cassette, the ribbon cassette housing an ink ribbon and including an upper wall and a perpendicular wall portion perpendicular to the upper wall at an outer periphery of the tape cassette;

the tape cassette including a housing portion into which the ribbon cassette is freely detachably mounted;

a detector detecting at least one of a type and an installation of the ribbon cassette; and a ribbon identifying portion extending outwardly from the perpendicular wall portion of the ribbon cassette and cooperating with the detector to identify the at least one of the type and the installation of the ribbon cassette.

2. A label printer as claimed in claim 1 wherein the upper wall of the ribbon cassette overlaps at least a portion of an upper surface of the tape cassette.

3. A label printer as claimed in claim 1 wherein the detector includes a ribbon color detector detecting color of the ink ribbon.

4. A label printer as claimed in claim 1 wherein the detector includes a ribbon width detector detecting width of the ink ribbon.

5. A label printer as claimed in claim 1 wherein the ribbon identifying portion includes a ribbon color portion having a configuration corresponding to a color of the ink ribbon.

6. A label printer as claimed in claim 1 wherein the ribbon identifying portion includes a ribbon width portion having a configuration corresponding to a width of the ink ribbon.

7. A label printer as claimed in claim 1 further comprising:

an input device inputting commands and symbols and alphanumeric characters;

a memory storing inputted data; and a display displaying inputted data.

8. A label printer as claimed in claim 1 wherein:

the detector includes a plurality of detection switches provided to the printer and a plurality of movable detection elements movably mounted to the tape cassette and operating corresponding ones of the plurality of detection switches provided to the printer; and the ribbon identifying portion includes at least one detected portion formed to the ribbon cassette in a preset combination pattern corresponding to a type of ink ribbon in the ribbon cassette, the at least one detected portion moving at least one of the plurality of movable detection elements toward the plurality of detection switches.

9. A label printer including as claimed in claim 8 wherein the tape cassette is further provided with a movable detection element portion formed with a plurality of mounting holes each opened at an end facing the detection switches and at an opposite end facing the ribbon identifying portion, each movable detection element being mounted movable within a predetermined stroke in a corresponding mounting hole.

10. A label printer as claimed in claim 9 wherein the ribbon identifying portion is further formed with at least one escape hole into which protrude any movable detection elements not moved by the at least one detected portion.

11. A label printer as claimed in claim 9 wherein each detection switch includes a detection portion and wherein each movable detection element is mounted so that each detection portion urges, via the end facing the detection switches, a corresponding movable detection element to protrude through the opposite end facing the ribbon identifying portion.

12. A label printer as claimed in claim 11 wherein the ribbon identifying portion is further formed with at least one escape hole into which protrudes the corresponding movable detection element under urging of a corresponding detection portion.

13. A printer as claimed in claim 11 wherein the at least one detected portion presses against, via the opposite end facing the ribbon identifying portion, the corresponding movable detection element with force greater than urging force of a corresponding detection portion.

14. A printer as claimed in claim 1 wherein the housing portion is configured to match configuration of a corresponding ribbon cassette.

15. A label printer as claimed in claim 1 wherein the tape cassette includes a tape identifying portion corresponding to a type of the tape cassette and indicating to the detector at least one of the type and an installation of the tape cassette.

16. A label printer as claimed in claim 15 wherein the detector determines at least one of the type and the installation of both the ribbon cassette and the tape cassette based on a combination of indications from the ribbon identifying portion and the tape identifying portion.

17. A label printer as claimed in claim 16 wherein:

the detector includes a plurality of detection switches provided to the printer and a plurality of movable detection elements movably mounted to the tape cassette and operating corresponding ones of the plurality of detection switches provided to the printer; and the ribbon identifying portion includes at least one detected portion formed to the ribbon cassette in a preset combination pattern corresponding to type of ink ribbon in the ribbon cassette, the at least one detected portion moving at least one of the plurality of movable detection elements toward the plurality of detection switches.

18. A composite cassette mountable in a printer including a print mechanism and a plurality of detection switches provided at a predetermined portion of the print mechanism, the composite cassette comprising:

a freely detachably mountable tape cassette housing a tape;

a ribbon cassette independent from the tape cassette, the ribbon cassette housing an ink ribbon, the ribbon cassette being detachably mountable in a housing portion of the tape cassette;

a plurality of movable detection elements movably mounted in the tape cassette and operating corresponding ones of the plurality of detection switches provided to the printer;

an operation portion operating the detection switches of the printer, the operation portion being provided to the ribbon cassette at a portion thereof corresponding to the predetermined portion of the print mechanism and in a configuration corresponding to the type of ribbon cassette, the operation portion including at least one detected portion formed to the ribbon cassette in a preset combination pattern corresponding to type of ink ribbon in the ribbon cassette, the at least one detected portion moving at least one of the plurality of movable detection elements toward the plurality of detection switches when the tape cassette is mounted in the print mechanism and the ribbon cassette is mounted in the tape cassette.

19. A label printer for printing tape-shaped labels, the label printer comprising:

a freely detachably mountable tape cassette housing a tape;

a printing device including a print head for printing symbols and alphanumeric characters on the tape;

a controller controlling printing operations;

a freely detachably mountable ribbon cassette independent from the tape cassette, the ribbon cassette housing an ink ribbon;

a housing portion into which the ribbon cassette is freely detachably mounted;

a detector detecting at least one of a type and an installation of the ribbon cassette; and a ribbon identifying portion provided to the ribbon cassette and indicating to the detector the at least one of the type and the installation of the ribbon cassette, wherein the tape cassette includes a tape identifying portion corresponding to a type of the tape cassette and indicating to the detector at least one of the type and an installation of the tape cassette, and wherein the detector determines at least one of the type and the installation of both the ribbon cassette and the tape cassette based on combined indications from the ribbon identifying portion and the tape identifying portion.

20. A label printer as claimed in claim 19 wherein:

the detector includes a plurality of detection switches provided to the printer and a plurality of movable detection elements movably mounted to the tape cassette and operating corresponding ones of the plurality of detection switches provided to the printer; and the ribbon identifying portion includes at least one detected portion formed to the ribbon cassette in a preset combination pattern corresponding to type of ink ribbon in the ribbon cassette, the at least one detected portion moving at least one of the plurality of movable detection elements toward the plurality of detection switches.

* * * * *